US009010674B2

(12) United States Patent
Izumi

(10) Patent No.: US 9,010,674 B2
(45) Date of Patent: Apr. 21, 2015

(54) ROLL SHEET SUPPORTING APPARATUS

(75) Inventor: Masato Izumi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 206 days.

(21) Appl. No.: 13/368,205

(22) Filed: Feb. 7, 2012

(65) Prior Publication Data

US 2012/0205485 A1 Aug. 16, 2012

(30) Foreign Application Priority Data

Feb. 10, 2011 (JP) ..... 2011-027231

(51) Int. Cl.
*B65H 75/24* (2006.01)
*B65H 29/00* (2006.01)

(52) U.S. Cl.
CPC ..... *B65H 29/008* (2013.01); *B65H 2301/4165* (2013.01); *B65H 2301/4193* (2013.01); *B65H 2801/15* (2013.01)

(58) Field of Classification Search
CPC .... B65H 16/06; B65H 19/126; B65H 75/185; B65H 75/242; B65H 2301/41346
USPC ..... 242/596, 596.1–596.3, 571.8, 242/573.3–573.4, 574, 575.5, 598
See application file for complete search history.

(56) References Cited

U.S. PATENT DOCUMENTS

| | | | | |
|---|---|---|---|---|
| 3,278,134 | A * | 10/1966 | Cochrane | 242/573.5 |
| 7,100,859 | B2 * | 9/2006 | Kayanuma et al. | 242/348 |
| 2007/0034727 | A1 * | 2/2007 | Kaya | 242/571.8 |
| 2011/0262202 | A1 * | 10/2011 | Izumi | 400/621 |

FOREIGN PATENT DOCUMENTS

| | | | |
|---|---|---|---|
| JP | 8-175707 | A | 7/1996 |
| JP | 2010100087 | A * | 5/2010 |

* cited by examiner

*Primary Examiner* — Sang Kim
(74) *Attorney, Agent, or Firm* — Canon USA Inc IP Division

(57) ABSTRACT

A roll sheet supporting apparatus includes a pair of rotation shafts which are respectively fitted into end portions of the hollow portion of the core tube and configured to support the roll sheet rotatably and capable of being drawn out, an engaging member movable between a projecting position and a retracting position, wherein the engaging member projects from an outer circumferential surface of the each rotation shaft abutting on the core tube to engage with the core tube at the projecting position and retracts inward from the outer circumferential surface of the each rotation shaft at the retracting position, and an engaging member moving unit configured to move the engaging member between the projecting position and the retracting position.

13 Claims, 16 Drawing Sheets

WHEN FIXING ROLL CORE

WHEN RELEASING FIXATION OF ROLL CORE

LOCKING BY FIXING OPERATION OF ROLL CORE

RELEASING LOCK BY FIXING OPERATION OF ROLL CORE

DETAIL OF CAM MECHANISM UNIT

ROLL SHEET SUPPORTING APPARATUS

BACKGROUND OF THE INVENTION

1. Field of the Invention

The present invention relates to a printing apparatus including a roll sheet supporting apparatus and a sheet processing apparatus.

2. Description of the Related Art

Japanese Patent Application Laid-Open No. 08-175707 discusses a supporting apparatus of a roll sheet applicable to a printing apparatus. The roll sheet is formed by winding a sheet around an outer circumferential surface of a hollow core tube. A supporting apparatus which is fitted into both ends of the core tube of the roll sheet supports the roll sheet rotatably. The supporting apparatus includes a driven unit to which driving force is transmitted and a transmission member which transmits rotational force of the driven unit. In an inner circumferential surface of the hollow core tube, a flange fixing auxiliary member is provided near the both ends thereof to detachably support the supporting apparatus to the core tube. The transmission member is engaged with the flange fixing auxiliary member, so that the supporting apparatus is fixed to the roll sheet. The flange fixing auxiliary member is configured as a step portion projecting inside from the inner circumferential surface of the core tube. The step portion is integrally formed with the core tube or formed by inserting another member in the core tube.

With this configuration, replacement work of the roll sheet can be improved compared with the conventional method in which the roll sheet is fixed by penetrating a supporting shaft into the core portion of the roll sheet, since it is not necessary to insert a long shaft into the roll sheet.

When the supporting apparatus is fixed to the core tube in the printing apparatus, flexibility of the method for certainly fixing the supporting apparatus can be increased by providing the flange fixing auxiliary member. However, providing the flange fixing auxiliary member may increase configuration members or complexity of the core tube itself. Therefore, simpler configuration which does not use the flange fixing auxiliary member has been desired.

With or without the flange fixing auxiliary member, as a fixing method of the supporting apparatus, a configuration has been widely used in which a leading edge portion of the supporting apparatus presses the inner circumferential surface of the core tube or the flange fixing auxiliary member. However, in this configuration, when the supporting apparatus is attached to the core tube, an outer diameter of the leading edge portion of the supporting apparatus may enlarge wider than an inner diameter of the core tube or the flange fixing auxiliary member, so that the supporting apparatus may be prevented from being inserted into the core tube. As a result, the supporting apparatus cannot be attached properly to the end portion of the roll sheet. Further, when the supporting apparatus is inserted or when the leading edge portion of the supporting apparatus presses the inner circumferential surface of the core tube or the flange fixing auxiliary member, an impact is applied to the supporting apparatus, so that the supporting apparatus may be broken. Therefore, the configuration which can simply and certainly attach the supporting apparatus has been desired.

SUMMARY OF THE INVENTION

The present invention directs to a supporting apparatus for supporting a roll sheet in which a sheet is wound in a roll shape on an outer circumferential surface of a core tube with a hollow portion having a constant cross section along an axial direction, more particularly, the supporting apparatus which can easily and certainly attach to a roll sheet without providing a flange fixing auxiliary member to the core tube.

A roll sheet supporting apparatus according to the present invention is a supporting apparatus for supporting a roll sheet in which a sheet is wound in a roll shape on an outer circumferential surface of a core tube with a hollow portion having a constant cross section along an axial direction. According to an aspect of the present invention, a roll sheet supporting apparatus capable of supporting a roll sheet which is wound in a roll shape on an outer circumferential surface of a core tube having a hollow portion includes a pair of rotation shafts which are respectively fitted into end portions of the hollow portion of the core tube and configured to support the roll sheet rotatably and capable of being drawn out, an engaging member movable between a projecting position and a retracting position, wherein the engaging member projects from an outer circumferential surface of the each rotation shaft abutting on the core tube to engage with the core tube at the projecting position and retracts inward from the outer circumferential surface of the each rotation shaft at the retracting position, and an engaging member moving unit configured to move the engaging member between the projecting position and the retracting position.

The engaging member is configured to be movable between the projecting position at which the engaging member projects from a groove on the outer circumferential surface of the rotation shaft to engage with the core tube and the retracting position at which the engaging member retracts inward from the outer circumferential surface of the rotation shaft. The engaging member is set at the retracting position when the supporting apparatus is mounted and positions inward from the outer circumferential surface of the rotation shaft, so that the engaging member does not project from the outer circumferential surface. Therefore, the rotation shaft can be easily and certainly mounted to the roll sheet. When the supporting apparatus is fixed to the roll sheet, an operator only needs to protrude the engaging member from the outer circumferential surface of the rotation shaft to engage with the core tube, so that it is not necessary to provide the flange fixing auxiliary member. Therefore, if the core tube has a simple structure with a hollow portion having a constant cross section along the axial direction, the operator can easily fix the supporting apparatus to the roll sheet.

As described above, according to the present invention, it is not necessary to provide the flange fixing auxiliary member to the core tube and the supporting apparatus which can be easily and certainly mounted to the roll sheet can be provided.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

An exemplary embodiment of an ink-jet method printing apparatus will be described below. The printing apparatus according to the present exemplary embodiment is a high speed line printer corresponding to both of one-sided printing and two-sided printing of a long continuous sheet. Such printing apparatus can be preferably used for printing a large amount of sheets, for example, in a printing laboratory. The long continuous sheet is a continuous sheet prolonging more in a conveying direction than a length of a unit image which is a unit of a repeating print. The unit image is one print unit (one page) when a plurality of pages is successively printed one by one on a continuous sheet. If a plurality of small images, characters, and spaces are included in one print unit in a mixed state, those included in the relevant area are collectively referred to as one unit image. A length of the unit image is different according to an image size to be printed. For example, the length in the sheet conveying direction of an L-size photograph is 135 mm and the length in the sheet conveying direction of an A4 size sheet is 297 mm.

The present invention is widely applicable to a printing apparatus, such as a printer, a multifunction peripheral, a copying machine, a facsimile apparatus, manufacturing apparatus of various devices. As for print processing, the present invention is applicable in any methods, such as an ink-jet method, an electrophotographic method, a thermal transfer method, a dot impact method, and a liquid developer method. The present invention is also applicable to a sheet processing apparatus which performs various types of processing on the roll sheet, such as recording, processing, coating, irradiation, reading, and inspection, not limited in the print processing.

Figure 1:
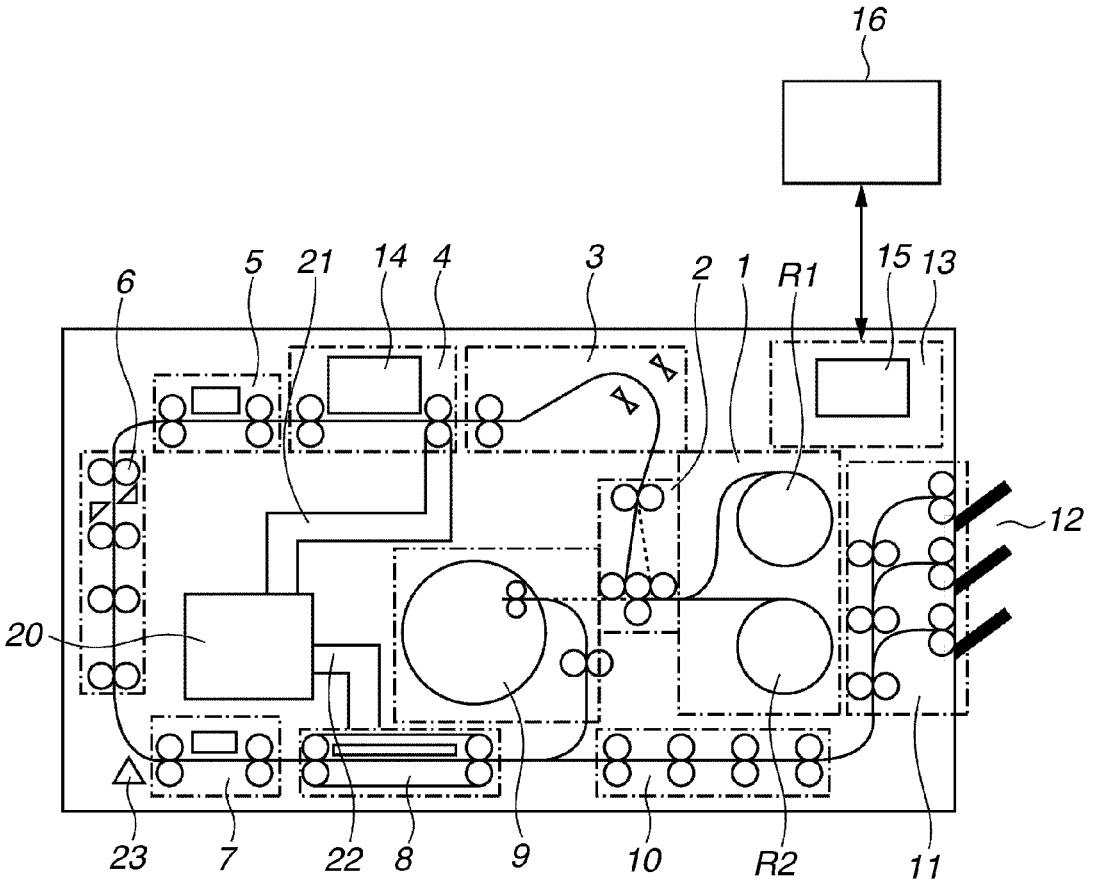
FIG. 1 is a schematic view illustrating an internal configuration of a printing apparatus.

FIG. 1 is a schematic cross sectional view illustrating an internal configuration of a printing apparatus. The printing apparatus according to the present embodiment can perform two-sided printing on a first surface of a sheet wound in a roll state and on a second surface backside of the first surface. The printing apparatus includes each unit inside thereof, that is, a sheet feeding unit 1, a decurling unit 2, a skew correction unit 3, a printing unit 4, an inspection unit 5, a cutter unit 6, an information recording unit 7, a drying unit 8, a reversing unit 9, a discharge conveying unit 10, a sorter unit 11, a discharging unit 12, a humidification unit 20, and a control unit 13.

A sheet is conveyed by a conveyance mechanism including roller pairs and belts along a sheet conveyance path illustrated by a solid line in FIG. 1, and processed by each unit. At an arbitrary position in the sheet conveyance path, a side near the sheet feeding unit 1 is referred to as "upstream" and a side opposed to the upstream is referred to as "downstream".

The sheet feeding unit 1 supports a continuous sheet wound in a roll state and feeds it. The sheet feeding unit 1 can store two rolls R1 and R2 and alternatively draw out and feed the sheet from the roll R1 or the roll R2. The number of rolls that can be stored is not limited two and the sheet feeding unit 1 can store one roll, or three or more rolls.

The decurling unit 2 reduces curl (curvature) of the sheet fed from the sheet feeding unit 1. The decurling unit 2 includes two pinch rollers to one driving roller. The decurling unit 2 passes the sheet through the pinch rollers so as to curve the sheet in a direction to apply an opposite curvature to the curl. By this processing, decurling force generates and reduces the curl. The decurling unit 2 can adjust the decurling force.

The skew correction unit 3 corrects skew of the sheet passed the decurling unit 2. The skew is an inclination to an original moving direction. The skew of the sheet can be corrected by pressing a sheet end of a reference side to a guide member.

The printing unit 4 performs print processing on the sheet by a printing head 14 from above the conveyed sheet and forms an image. That is, the printing unit 4 is a processing unit for performing predetermined processing to the sheet. The printing unit 4 further includes a plurality of conveying rollers for conveying the sheet.

The printing head 14 is a line type printing head in which an ink jet method nozzle array is formed in a range covering the maximum width of the sheet assumed to be used. The printing head 14 includes a plurality of printing heads arranged in parallel along the conveying direction. In the present exemplary embodiment, the printing head 14 includes seven printing heads corresponding to seven colors, i.e., cyan (C), magenta (M), yellow (Y), light cyan (LC), light magenta (LM), gray (G), black (K). The numbers of colors and printing heads are not limited by seven. As for the ink-jet method, various methods such as a method using a heating element, a method using a piezoelectric element, a method using an electrostatic element, and a method using a micro-electromechanical system (MEMS) element, can be used. Each color ink is supplied from each ink tank to the printing head 14 through each ink tube. As described below, the printing head 14 can move in the direction retreating from the sheet in the printing unit 4. With this configuration, an interval of the print head 14 to the sheet can be adjusted.

The inspection unit 5 optically reads an inspection pattern or an image, which is printed on a sheet by the printing unit 4, with a scanner, inspects a state of the nozzles in the printing head 14, a sheet conveyance state, and an image position, and determines whether the image is properly printed. The scanner may include a charge coupled device (CCD) image sensor or a complementary metal oxide semiconductor (CMOS) image sensor.

The cutter unit 6 includes a mechanical cutter for cutting the printed sheet to a predetermined length. The cutter unit 6 also includes a plurality of conveying rollers for feeding the sheet to a next step.

The information recording unit 7 records printing information, such as serial numbers and date of printing, on a non-printing area in the cut sheet. The printing information is recorded by printing characters or codes by the ink-jet method or the thermal transfer method. In the upstream side of the information recording unit 7 and the downstream side of the cutter unit 6, a sensor 23 for detecting a leading edge of the cut sheet is provided. The sensor 23 detects the sheet edge between the cutter unit 6 and a recording position of the information recording unit 7. Based on the detection timing by the sensor 23, the recording timing in the information recording unit 7 is controlled.

The drying unit 8 heats the sheet printed by the printing unit 4 and dries applied inks in a short time. In the drying unit 8, heated air is supplied at least from below to the passing sheet and dries the ink applied surface. The drying method is not limited to the heated air supplying method. A method for irradiating the sheet surface with an electromagnetic wave, for example, ultraviolet rays or inferred rays, can be also applied.

The sheet conveyance path from the sheet feeding unit 1 to the drying unit 8 is referred to as a first path. The first path has a U-turn shape between the printing unit 4 and the drying unit 8 and the cutter unit 6 positions in the middle of the U-turn shape.

The reversing unit 9 temporary winds the continuous sheet that finishes printing on a front surface and turns over the front and the back of the sheet, when the two-sided printing is performed. The reversing unit 9 is provided in the middle of the path for supplying the sheet passed through the drying unit 8 to the printing unit 4 again. This path is a loop path from the drying unit 8 to the printing unit 4 through the decurling unit 2 and is referred to as a second path. The reversing unit 9 includes a winding rotary member (drum) rotating for winding the sheet. The continuous sheet which has finished the printing on its front surface and has not been cut is temporary wound on the winding rotary member. When finishing winding, the winding rotary member reversely rotates, so that the wound sheet is supplied to the decurling unit 2 and fed to the printing unit 4. Since the front and the back of the sheet is reversed, the printing unit 4 can perform printing on the back surface. A more detailed operation of the two-sided printing will be described below.

The discharge conveying unit 10 conveys the sheet cut by the cutter unit 6 and dried by the drying unit 8, and delivers the sheet to the sorter unit 11. The discharge conveying unit 10 is provided in a path different from the second path on which the reversing unit 9 is provided. The different path is referred to as a third path. For selectively guiding the sheet conveyed from the first path to any one of the second path and the third path, a path switching mechanism having a movable flapper is provided at a branching position in the path.

The sorter unit 11 and the discharge unit 12 are provided at a side of the sheet conveying unit 1 and at an end of the third path. The sorter unit 11 sorts the printed sheets by group as necessary. The sorted sheets are discharged to the discharge unit 12 including a plurality of trays. The third path passes under the sheet feeding unit 1 to discharge the sheets to the opposite side of the printing unit 4 and the drying unit 8, across the sheet feeding unit 1.

As described above, in the first path, the units from the sheet feeding unit 1 to the drying unit 8 are provided in order. After the drying unit 8, the first path branches into the second path and the third path. The second path includes the reversing unit 9 at the middle, and joints to the first path after the reversing unit 9. The thirds path includes the discharge unit 12 at the end thereof.

The humidification unit 20 generates and feeds a humidified gas (air) between the sheet and the printing head 14 in the printing unit 4. With this configuration, drying of the ink in the nozzles in the printing head 14 can be reduced. As a humidification method in the humidification unit 20, a vaporization method, a water spraying method, and a steam method can be used. In the vaporization method, there are a moisture permeable membrane type, a drop pervaporation type, a capillary type, and so on in addition to a rotation type in the present exemplary embodiment. In the water spraying method, there are an ultrasonic type, a centrifugal type, a high pressure spray type, a twin-fluid atomization type, and so on. In the steam method, there are a steam piping type, an electro thermal type, an electrode type, and so on.

The humidification unit 20 and the printing unit 4 are connected by a first duct 21, and further the humidification unit 20 and the drying unit 8 are connected by a second duct 22. In the drying unit 8, a high temperature and high humidity gas is generated when the sheet is dried. This gas is guided to the humidification unit 20 through the second duct 22 and used as auxiliary energy for generating the humidified gas in the humidification unit 20. The humidified gas generated in the humidification unit 20 is guided to the printing unit 4 through the first duct 21.

The control unit 13 controls each unit in the printing apparatus. The control unit 13 includes a central processing unit (CPU), a storage device, a controller including various control units, an external interface, and an operation unit 15 that a user performs input/output. An operation of the printing apparatus is controlled based on an instruction from the controller or a host apparatus 16 such as a host computer connected to the controller via the external interface.

Figure 2:
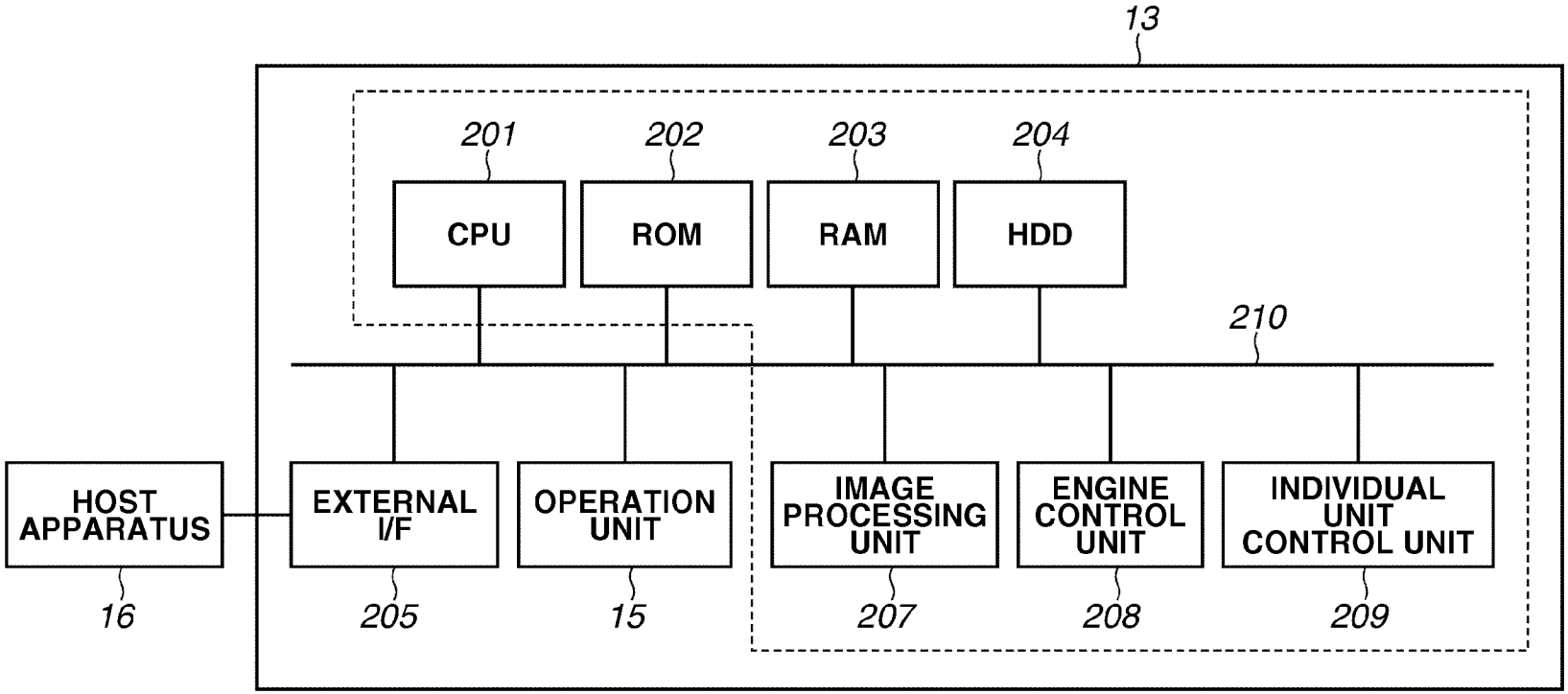
FIG. 2 is a block diagram of a control unit.

FIG. 2 is a block diagram illustrating a concept of the control unit 13. The controller, which is a range enclosed with a dashed line in FIG. 2, included in the control unit 13 includes a CPU 201, a read only memory (ROM) 202, a random access memory (RAM) 203, a hard disk drive (HDD) 204, an image processing unit 207, an engine control unit 208, and an individual unit control unit 209.

The CPU 201 comprehensively controls operations of each unit in the printing apparatus. The ROM 202 stores programs executed by the CPU 201 and fixed data pieces necessary for various operations of the printing apparatus. The RAM 203 is used as a work area of the CPU 201 and a temporary storage area of various received data pieces, and stores various setting data pieces. The HDD 204 can store and read the programs executed by the CPU 201, print data, and setting information necessary for various operations of the printing apparatus. The operation unit 15 is an input/output interface used by a user and includes an input unit such as a hard key and a touch panel, and an output unit such as a display and an audio generator which provide information.

The unit required high speed data processing is provided with an exclusive processing unit. The image processing unit 207 performs image processing of print data handled in the printing apparatus. A color space of input image data, for example, YCbCr, is converted to a standard red-green-blue (RGB) color space, for example, standard RGB (sRGB). Various types of image processing, such as resolution conversion, image analysis, and image correction, are performed on the image data as necessary. The print data acquired by these image processing is stored in the RAM 203 or the HDD 204.

The engine control unit 208 performs driving control of the printing head 14 in the printing unit 4 according to print data based on a control command received from the CPU 201. The engine control unit 208 further controls a conveyance mechanism in each unit in the printing apparatus.

The individual unit control unit 209 is a sub-controller for individually controlling each unit, i.e., the sheet feeding unit 1, the decurling unit 2, the skew correction unit 3, the inspection unit 5, the cutter unit 6, the information recording unit 7, the drying unit 8, the reversing unit 9, the discharge conveying unit 10, the sorter unit 11, the discharge unit 12, and the humidification unit 20. The individual unit control unit 209 controls operations of each unit based on a command from the CPU 201.

The external interface 205 is an interface (I/F) for connecting the controller to the host apparatus 16 and is a local I/F or a network I/F. The above-described constituent elements are connected by a system bath 210.

The host apparatus 16 is a supply source of image data for causing the printing apparatus to perform printing. The host apparatus 16 can be a general-purpose computer or a dedicated computer. The host apparatus 16 also can be a dedicated image apparatus such as, an image capture having an image reader unit, a digital camera, and a photo-storage. If the host apparatus is a computer, an operating system (OS), application software for generating image data, and a printing apparatus driver for the printing apparatus are installed in a storage apparatus included in the computer. It is not necessarily to realize the above-described processing by software, and a part of or entire processing can be realized by hardware.

Then, the basic operation at a time of printing will be described. The operation of printing is different in a one-sided print mode and in a two-sided print mode, so that each of them will be described.

Figure 3:
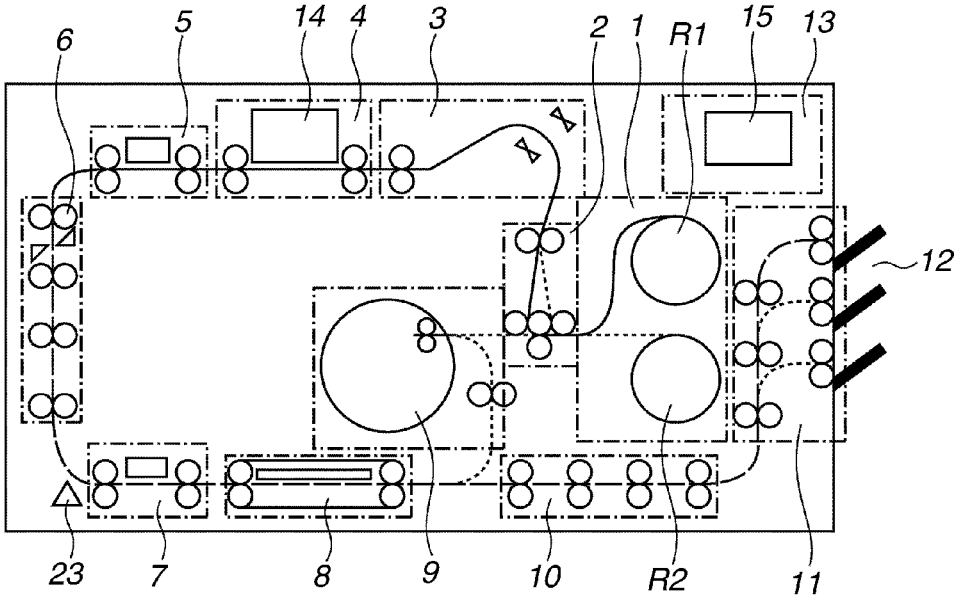
FIG. 3 illustrates an operation in a one-sided print mode.

FIG. 3 illustrates operations of printing in the one-sided print mode. The whole conveyance path in which a sheet fed from the sheet feeding unit 1 is printed and discharged to the discharge unit 12 is illustrated with a thick line. The sheet is fed from the sheet feeding unit 1, processed in the decurling unit 2 and the skew correction unit 3 respectively, and printed on a front surface (a first surface) in the printing unit 4. The printing unit 4 prints a unit image having a predetermined length in the conveying direction on a long continuous sheet one by one to form a plurality of images in order.

The printed sheet passes through the inspection unit 5 and is cut every unit image at the cutter unit 6. On the back surface of the cut sheet, sheet printing information is recorded in the information recording unit 7 as necessary. Then, the cut sheet is conveyed to the drying unit 8 one by one and dried. Then the sheet passes through the discharge conveying unit 10 and is discharged one by one to the discharge unit 12 in the sorter unit 11 to be stacked.

On the other hand, the sheet remained in the printing unit 4 side by cutting the last unit image is fed back to the sheet feeding unit 1 and wound by the roll R1 or the roll R2. As described below, at a time of feeding back, decurling force in the decurling unit 2 is adjusted to be low and the printing head 14 retracts from the sheet.

As described above, in the one-sided printing, the sheet passes the first path and the third path to be processed and does not pass the second path. Summarizing the above, in the one-sided print mode, the following sequences (1) to (6) are executed under the control of the control unit 13.

(1) Feeding a sheet from the sheet feeding unit 1 to supply it to the printing unit 4;

(2) Repeating printing of a unit image on the first surface of the fed sheet in the printing unit 4;

(3) Repeating cutting of the sheet by each unit image printed on the first surface in the cutter unit 6;

(4) Passing the sheet cut by each unit image through the drying unit 8 one by one;

(5) Discharging the sheet passed through the drying unit 8 one by one to the discharge unit 12 through the third path; and (6) Cutting the last unit image and feeding back the sheet remained in the printing unit 4 side to the sheet feeding unit 1.

Figure 4:
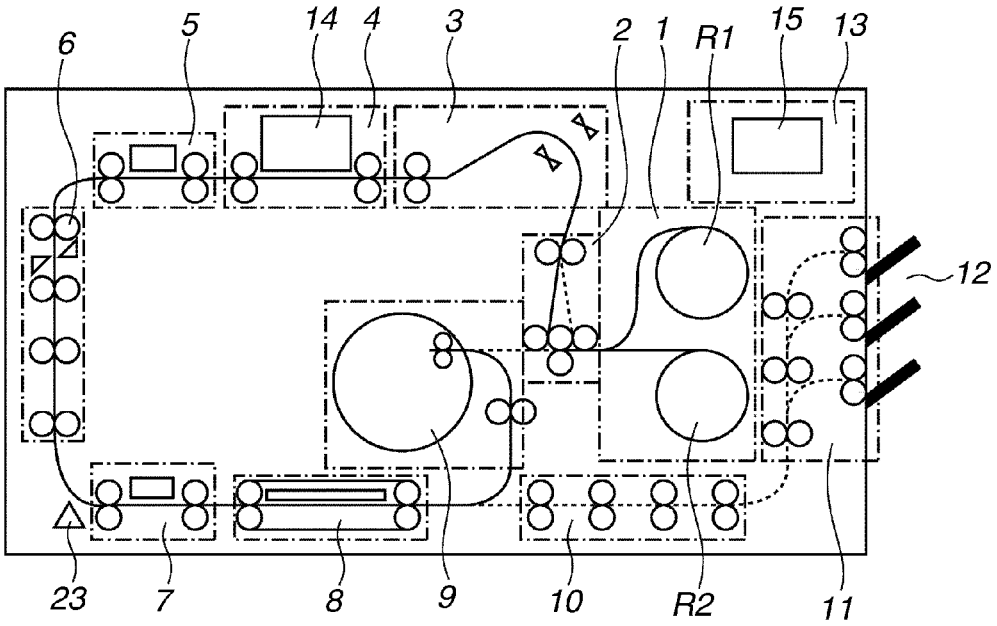
FIG. 4 illustrates an operation in a two-sided print mode.

FIG. 4 illustrates operations of printing in the two-sided print mode. In the two-sided printing, aback surface (second surface) print sequence is executed following the front surface (first surface) print sequence. In the front surface print sequence at the first time, operations in each unit from the sheet feeding unit 1 to the inspection unit 5 are the same as the operations in the above-described one-sided printing.

In the cutter unit 6, cutting operation is not performed and the sheet is conveyed to the drying unit 8 in a continuous state. After drying of the ink on the front surface in the drying unit 8, the sheet is not guided to the path in the conveying discharge unit 10 side (i.e., the third path) but guided to the path in the reversing unit 9 side (i.e., the second path). In the second path, the sheet is wound on the winding rotary member in the reversing unit 9 which rotates in forward direction (counterclockwise direction in FIG. 4). When all of the planned printing on the front surface is ended in the printing unit 4, the rear end of the printing range of the continuous sheet is cut in the cutter unit 6.

Based on a cut position, the continuous sheet on the downstream side in the conveying direction (the printed sheet side) is entirely wound till the rear end (the cut position) of the sheet in the reversing unit 9 through the drying unit 8. On the other hand, simultaneously with winding in the reversing unit 9, the continuous sheet remained on the upstream side in the conveying direction than the cut position (the printing unit 4 side) is fed back to the sheet feeding unit 1 so as not to leave the leading edge portion (the cut position) of the sheet in the decurling unit 2, and wound on the roll R1 or the roll R2. By this feeding back (backward feed) processing, the continuous sheet remained on the upstream side can avoid colliding with a sheet to be fed again by the following back surface print sequence. As described below, when the backward feed is performed, the decurling force in the decurling unit 2 is adjusted to be reduced and the printing head 14 is retracted from the sheet.

After the above-described front surface print sequence, the processing is switched to the back surface print sequence. The winding rotary member in the reversing unit 9 rotates in the reverse direction at the time of winding (clockwise direction in FIG. 4). The end of the wound sheet is fed to the decurling unit 2 along a path of a dashed line in FIG. 4. The end of the sheet at the time of winding becomes the leading edge of the sheet at the time of feeding. The decurling unit 2 corrects the curl on the sheet given by the winding rotary member. More specifically, the decurling unit 2 is provided between the sheet feeding unit 1 and the printing unit 4 in the first path, and between the reversing unit 9 and the printing unit 4 also in the second path. Thus, the decurling unit 2 is a common unit performing decurling in both paths.

The sheet reversed upside down is fed to the printing unit 4 through the skew correction unit 3 and printed on the back surface thereof. The printed sheet passes the inspection unit 5 and is cut for every predetermined unit length, which is set beforehand, in the cutter unit 6. Since the cut sheet is printed on both sides, the recoding is not performed in the information recording unit 7. The cut sheet is conveyed one by one to the drying unit 8, passes the discharge conveying unit 10, and is successively discharged to the discharge unit 12 in the sorter unit 11 to be stacked.

As described above, in the two-sided printing, the sheet passes the first path, the second path, the first path, and the third path in order and is processed. Summarizing the above, in the two-sided print mode, the following sequences (1) to (11) are executed under the control of the control unit 13.

(1) Feeding a sheet from the sheet feeding unit 1 to supply it to the printing unit 4;

(2) Repeating printing of a unit image on the first surface of the fed sheet in the printing unit 4;

(3) Passing the sheet printed on the first surface through the drying unit 8;

(4) Guiding the sheet passed through the drying unit 8 to the second path and winding the sheet on the winding rotary member in the reversing unit 9;

(5) After completion of the repeated printing on the first surface, cutting the sheet behind the unit image printed at last in the cutter unit 6;

(6) Winding the cut sheet on the winding rotary member till the end of the cut sheet passes the drying unit 8 and reaches to the winding rotary member, while feeding back the sheet remained in the printing unit 4 side after cutting to the sheet feeding unit 1;

(7) After winding, reversely rotating the winding rotary member and feeding again the sheet from the second path to the printing unit 4;

(8) Repeating printing of the unit image on the second surface of the sheet fed from the second path in the printing unit 4;

(9) Repeating cutting of the sheet by every unit image printed on the second surface in the cutter unit 6;

(10) Passing the sheet cut by each unit image through the drying unit 8 one by one; and

(11) Discharging the sheet passed through the drying unit 8 one by one to the discharge unit 12 through the third path.

Figure 5A:
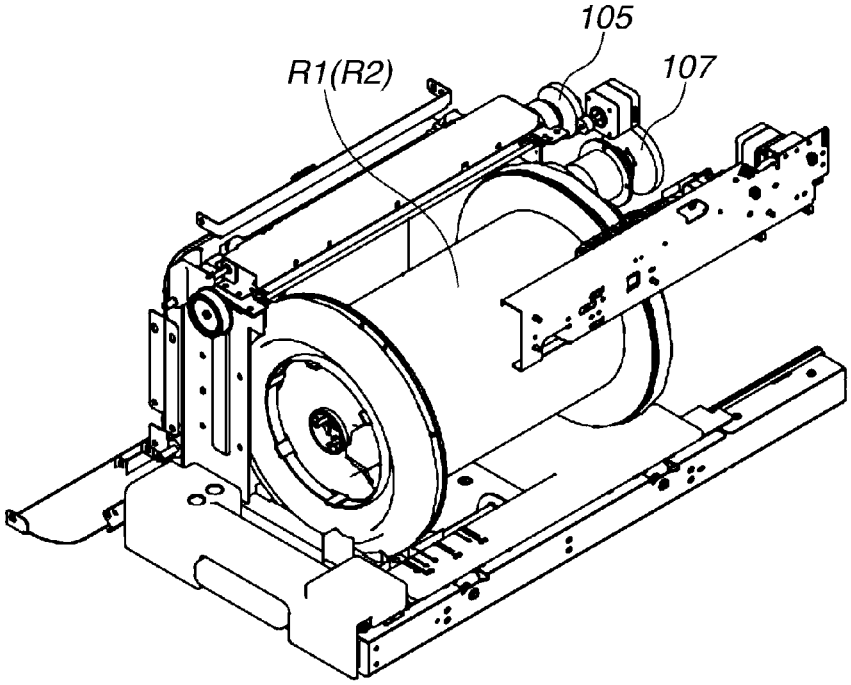
FIGS. 5A and 5B illustrate a configuration and an operation of a sheet feeding unit.
Figure 5B:
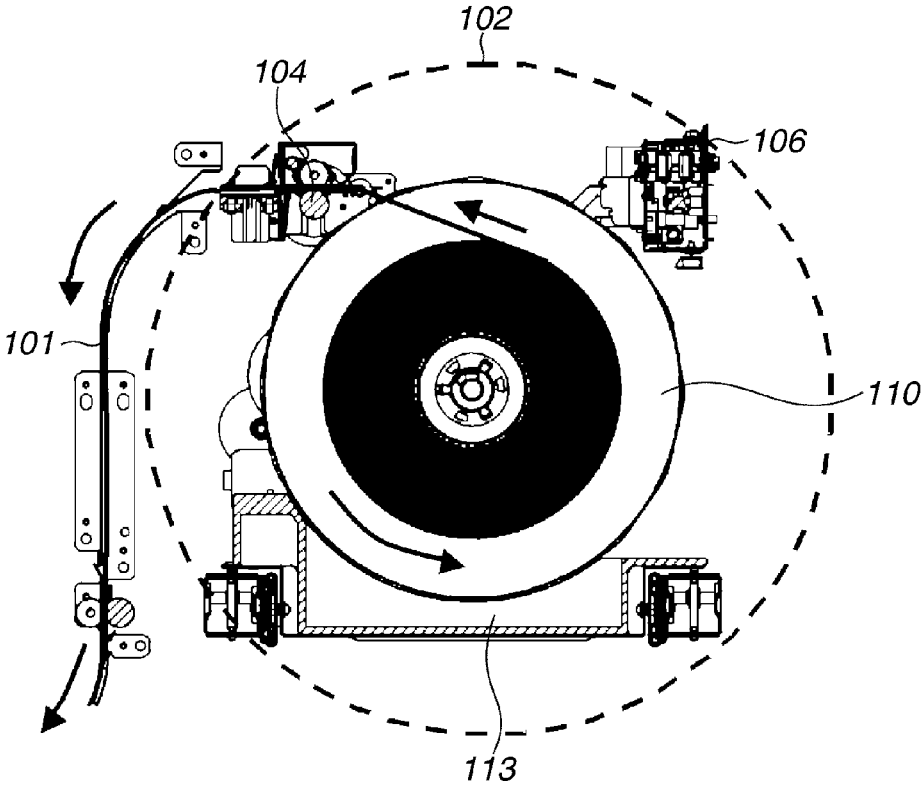

FIGS. 5A and 5B illustrate a configuration and an operation of the sheet feeding unit 1. The sheet feeding unit 1 stores a continuous sheet, which is supported in the roll sheet supporting apparatus (hereinafter referred to as a supporting apparatus 110) and wound in a roll shape, and feeds the sheet to a sheet conveyance path 101 connected to the printing apparatus 4. FIG. 5A illustrates a perspective view of the sheet feeding unit 1. FIG. 5B illustrates a cross-sectional view of the sheet feeding unit 1.

A sheet storage unit 102 includes a flange supporting member 103, a sheet feeding roller pair 104, a sheet feeding roller driving unit 105 for transmitting driving force to the sheet feeding roller pair 104, a mechanism portion 106 for detecting a sheet type and a sheet width size, and a roll driving unit 107 for rotating the roll R1 (R2).

When the sheet feeding unit 1 feeds the sheet to the printing unit 4, the sheet feeding unit 1 rotates the sheet feeding roller pair 104 by transmitting the driving force from the sheet feeding roller driving unit 105 and conveys the sheet pinched by the sheet feeding roller pair 104 to the sheet conveyance path 101. When the sheet feeding unit 1 rewinds the sheet to the sheet storage unit 102, the sheet feeding unit 1 transmits the driving force from the roll driving unit 107 to rotate the roll R1 (R2) and rewinds the sheet. At this time, the sheet feeding unit 1 separates the sheet feeding roller pair 104 or rotates the sheet feeding roller pair 104 in reverse direction to the conveying direction, and conveys the sheet.

When the sheet is rewound, a speed of the sheet feeding roller driving unit 105 and a speed of the roll driving unit 107 are controlled so that the speed of the roll driving unit 107 is always faster than that of the sheet feeding roller driving unit 105. Thus, tension is applied between the sheet feeding roller pair 104 and the roll R1 (R2). The difference of the sheet conveying speeds between the sheet feeding roller driving unit 105 and the roll driving unit 107 can be canceled by sliding a clutch (not illustrated) provided in the roll driving unit 107.

Figure 6A:
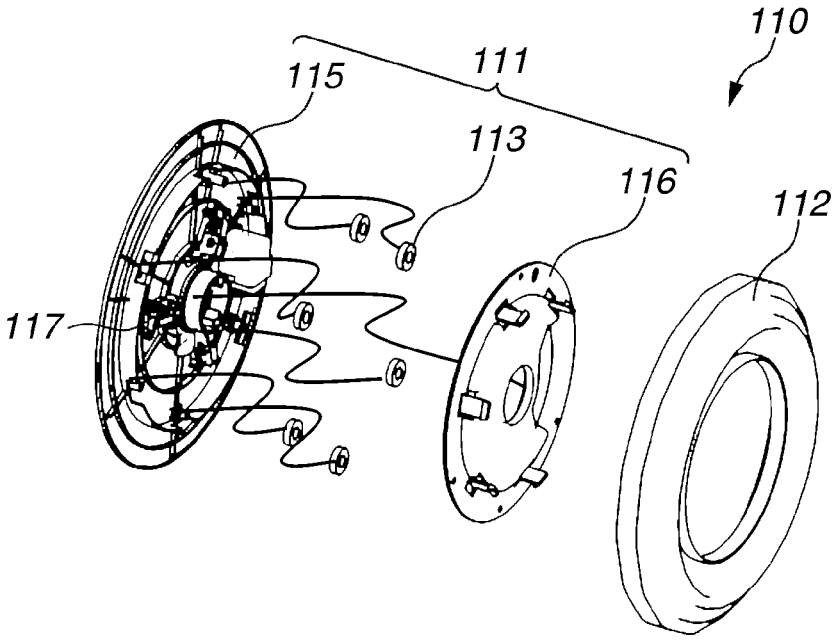
FIGS. 6A to 6D illustrate a configuration of a supporting apparatus.
Figure 6B:
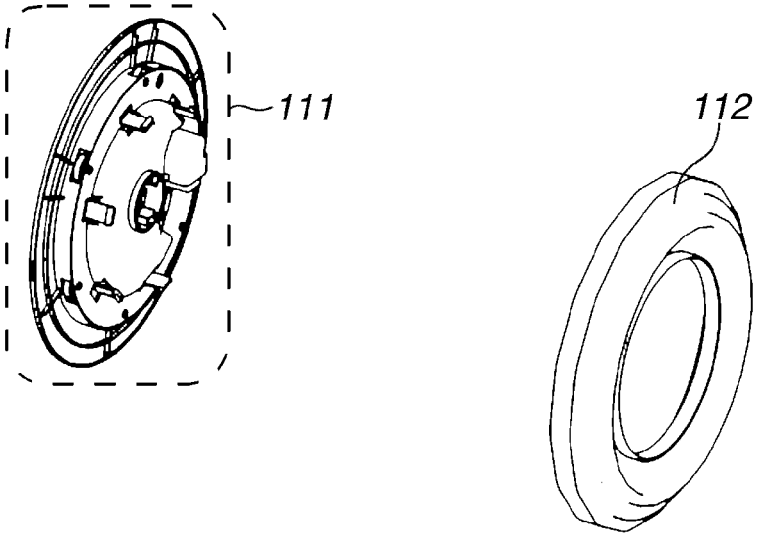
Figure 6D:
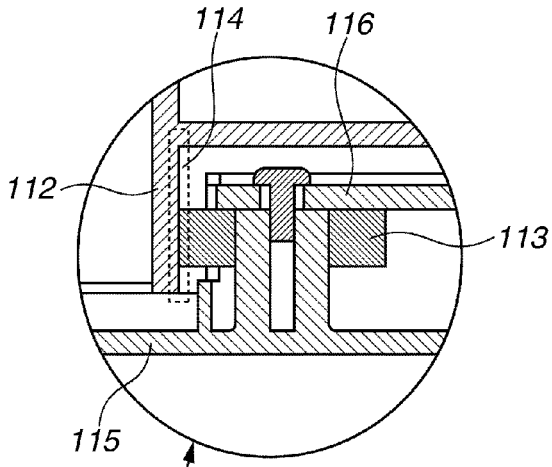
Figure 6C:
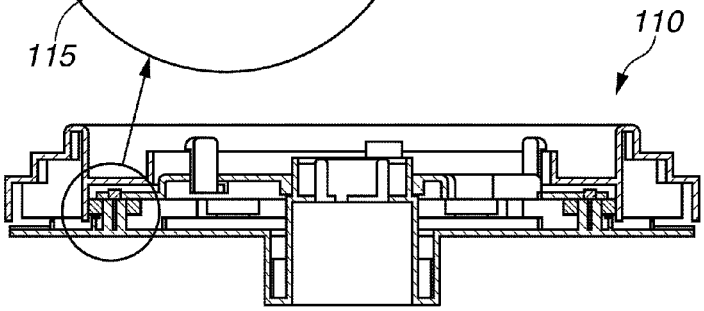

FIGS. 6A to 6C illustrate a configuration of the roll sheet supporting apparatus 110. FIG. 6A is an exploded perspective view illustrating an internal configuration of the supporting apparatus 110. FIG. 6B is an exploded perspective view illustrating the supporting apparatus 110 in a state in which a flange rotation unit 111 is assembled. FIG. 6C is a cross-sectional view of the supporting apparatus 110. FIG. 6D is a partial detail view near a bearing.

One pair of the supporting apparatuses 110 is provided to each of the rolls R1 and R2. Each supporting apparatus 110 includes the flange rotation unit 111 and a flange fixing portion 112, which rotatably supports the flange rotation unit 111 and is fixed to the flange supporting member 103. The flange rotation unit 111 transmits the driving force from the roll driving unit 107 and rotates a continuous sheet (hereinafter preferred to as a roll or a roll sheet), which is wound on the outer circumferential surface of a core tube 51 (refer to FIG. 7).

The core tube 51 of the roll has a hollow portion 52 which has a constant cross-section along in the axial direction, and generally is a circular tube having constant inner diameter and outer diameter. However, the shape of the hollow portion is not limited to the circle and can be a variable cross-section shape as long as the supporting apparatus 110 can be mounted to the roll and fixed by the engaging member as described below.

The flange rotation unit 111 includes a plurality of ring-shaped bearings 113, a flange unit 115, a bearing cover 116, and a fixing member 117. The plurality of bearings 113 is mounted to protrusion portions of the flange unit 115. The bearing 113 contacts to the flange fixing portion 112 at the side surface and is covered with the bearing cover 116 at the upper surface. When the sheet is fed, the bearing 113 slides on a sliding surface 114 of the flange fixing portion 112, so that the roll R1 (R2) can smoothly rotate. The bearing 113 also has a function of transmitting a weight of the roll R1 (R2) to the flange fixing portion 112, and load of the roll weight is distributed by providing the plurality of bearings.

Figure 7A:
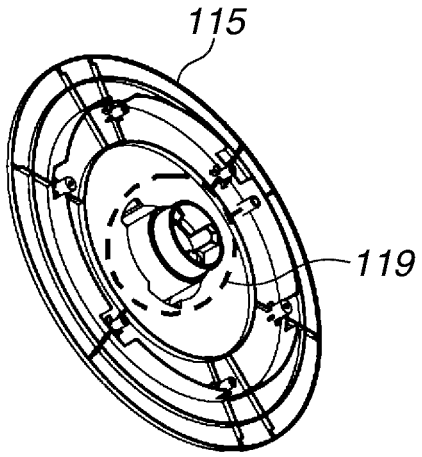
FIGS. 7A and 7B are perspective views illustrating an outer appearance of a flange unit.
Figure 7B:
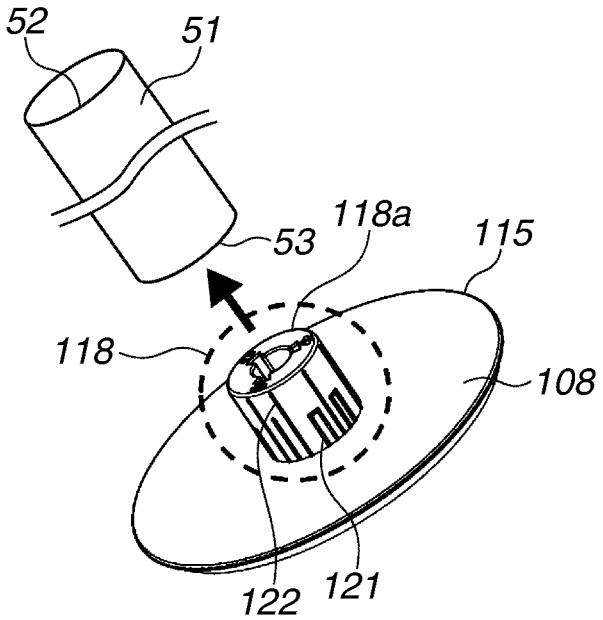

FIGS. 7A and 7B illustrate a configuration of the flange unit 115. FIG. 7 A illustrates an outer side surface engaging with the roll driving unit 107. FIG. 7B illustrates an inner side surface abutting on the roll R1 (R2). The flange unit 115 has an almost discal shape. On the one surface of the flange unit 115, a cylindrical rotation shaft 118, which is inserted into the core tube 51 of the roll R1 (R2), is integrally formed with the flange unit 115. An outside portion 119 of the flange unit 115 is mainly formed with the operation unit 133 described below.

The rotation shaft 118 can be formed separately from the flange unit 115 and fixed with the flange unit 115 by a proper method. The rotation shaft 118 is fitted into each end portion 53 of the hollow portion 52 of the core tube 51 and supports the roll sheet to be rotatable and to be drawn out. On the roll side of the flange unit 115, a guide surface 108 for guiding the end portion of the roll is formed.

Figure 8A:
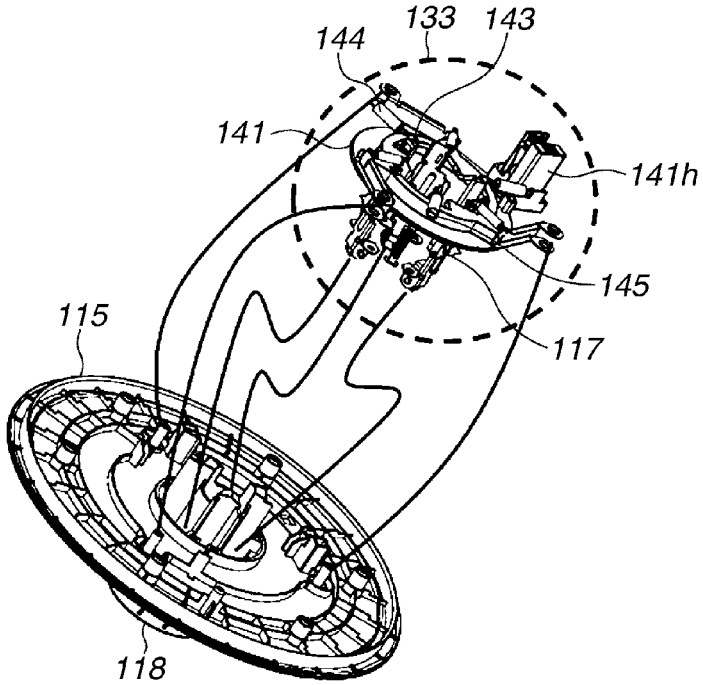
FIGS. 8A and 8B illustrate configurations of the flange unit and the operation unit.
Figure 8B:
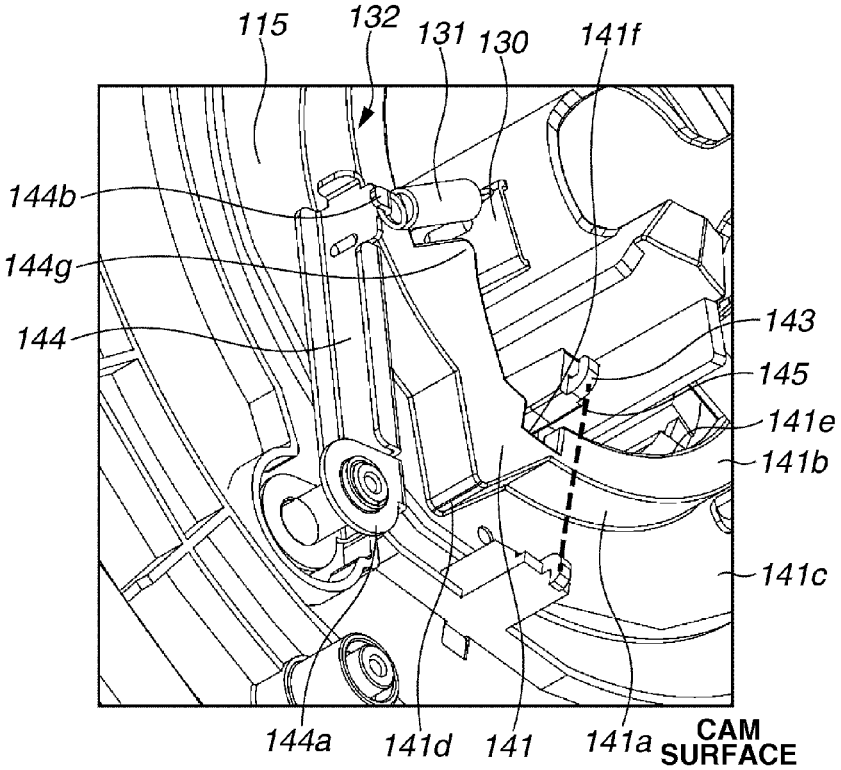

FIGS. 8A and 8B illustrate perspective views of the flange unit 115 and the operation unit 133. FIG. 8A is an exploded perspective view and FIG. 8B is a partial detailed view illustrating a combined part of the flange unit 115 and the operation unit 133. The flange unit 115 includes the fixing member 117 and the operation unit 133. The fixing member 117 fixes the rotation shaft 118 to the core tube 51. The operation unit 133 performs a fixing operation of the fixing member 117 to the core tube 51 and a fixing releasing operation of the fixing member 117 from the core tube 51.

Figure 9A:
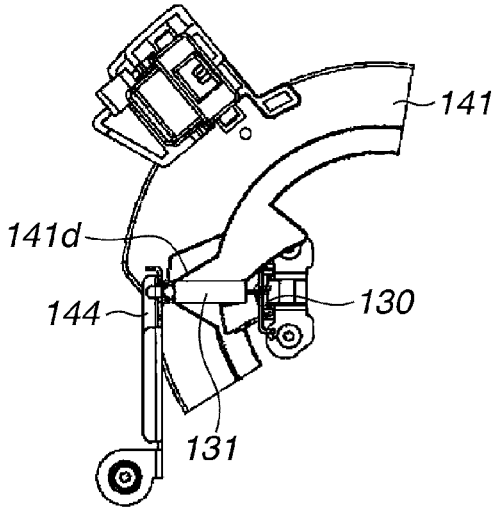
FIGS. 9A to 9C illustrate a position relationship and an operation between a fixing member and a cam which moves the fixing member.
Figure 9B:
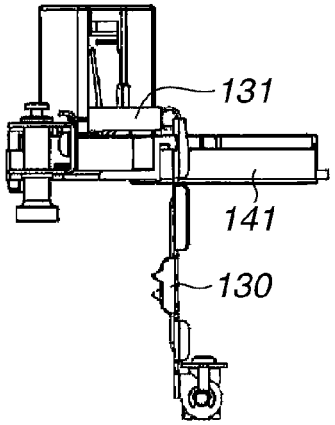
Figure 9C:
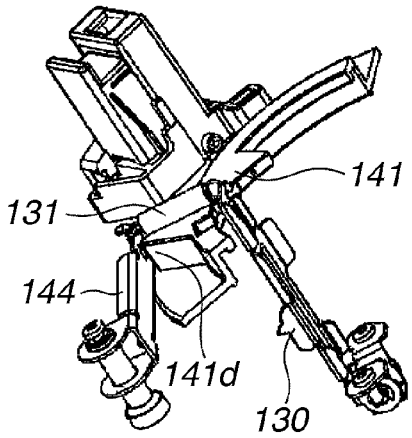
Figure 10A:
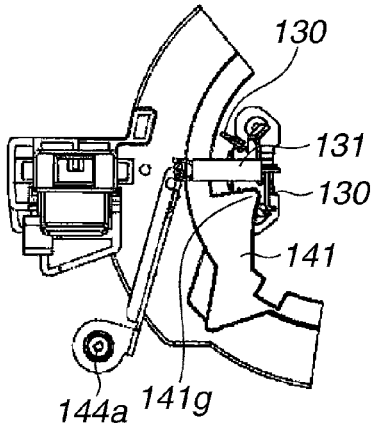
FIGS. 10A to 10C illustrate a position relationship and an operation between the fixing member and the cam which moves the fixing member.
Figure 10B:
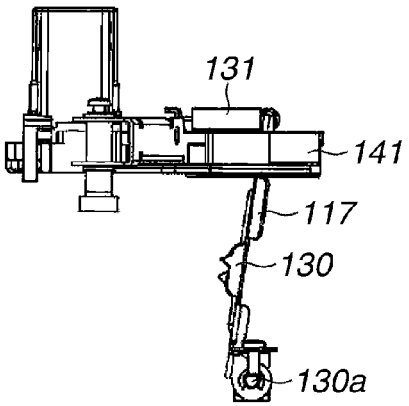
Figure 10C:
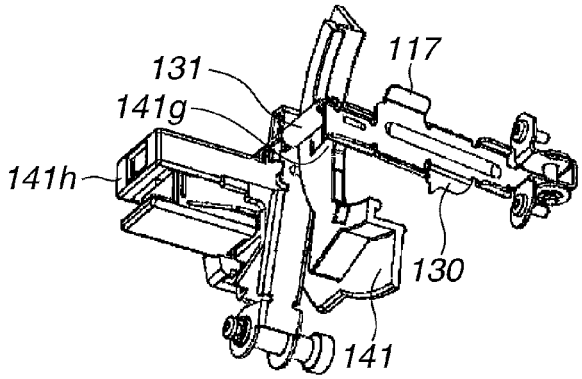

FIGS. 9A to 9C and FIGS. 10A to 10C illustrate position relationships and operations of the fixing member 117 and a cam member 141 for moving the fixing member 117. FIG. 9A and FIG. 10A are plane views as viewed from the cam member side 141. FIG. 9B and FIG. 10B are side views, and FIG. 9C and FIG. 10C are perspective views. FIGS. 9A to 9C illustrate a state in which the core tube 51 is fixed by the fixing member 117. FIGS. 10A to 10C illustrate a state in which the fixing is released.

The fixing member 117 is movably supported by a shaft 130*a* in the inner surface side of a leading edge wall 118*a* of the rotation shaft 118. The fixing member 117 includes an engaging member 130 having a sharp leading edge for engaging to the core tube 51. The engaging member 130 is a plate-like metal member made by sheet metal processing. Grooves 121 are formed on an outer surface of the rotation shaft 118 (refer to FIG. 7B). The leading edge portion of the engaging member 130 can project outside of the outer surface of the rotation shaft 118 through the groove 121 by an operation of an engaging member moving mechanism 132 which will be described below.

In other words, the engaging member 130 can move between a projecting position and a retracting position. At the projecting position, the engaging member 130 projects from the outer circumferential surface of the rotation shaft 118 abutting on the core tube 51 through the groove 121 and engage with the core tube 51. At the retracting position, the engaging member 130 retracts inside from the outer circumferential surface of the rotation shaft 118. With this configuration, the engaging member 130 can move in the radial direction and repeat engaging and separating to the core tube 51. The radial direction is defined based on a center axis in a plane perpendicular to a center axis of the rotation shaft 118.

The engaging member moving mechanism 132 is provided in the operation unit 133 and moves the engaging member 130 between the projecting position and the retracting position. The engaging member moving mechanism 132 includes a cam member 141, a rotating member 144, and a first spring member 131.

The cam member 141 includes an upper half portion 141*b* having a cam surface 141*a* and a lower half portion 141*c* having an almost discal shape which is integrally formed with the upper half portion 141*b*. On the cam surface 141*a*, three convex portions 141*d* which protrude outside and are located approximately equal intervals are formed. The lower half portion 141*c* of the cam member 141 is rotatably held in an area surrounded by two concentric guide walls of the flange unit 115. Accordingly, the cam member 141 is disposed coaxially with the rotation shaft 118 and configured to be relatively rotatable with respect to the rotation shaft 118.

The rotating member 144 is supported by a fulcrum 144*a* fixed to the rotation shaft 118 at one end thereof, and configured to be rotatable centering the fulcrum 144*a*. In the present exemplary embodiment, the fulcrum 144*a* is the protrusion 144*a* provided in the flange unit 115. The first spring member 131 is made of, for example, a coil spring, and one end thereof is connected to an end portion 144*b* of the rotating member 144 and another end is connected to a leading edge portion of the fixing member 117. The first spring member 131 is given the tensile force in advance and pulls the rotating member 144 inside to presses the rotating member 144 onto the cam surface 141*a* of the cam member 141.

The cam member 141 includes a grip portion 141*h*. A user can rotate the cam member 141 by operating the grip portion 141*h*. When the cam member 141 is rotated, an end portion of the cam member 141, which is connected to the engaging member 130 of the rotating member 144, is pushed to a convex portion 141*d* on the cam surface 141*a* of the cam member 141 to change the position outside in the radial direction. Accordingly, the rotating member 144 rotates centering the fulcrum 144*a* with the rotation of the cam member 141. By this rotation movement, the rotating member 144 moves the engaging member 130 between the projecting position and the retracting position via the first spring member 131.

The operation unit 133 further includes a locking mechanism. The locking mechanism locks rotation of the engaging member moving mechanism 132, especially the cam member 141, when the engaging member positions at the retracting position.

Figure 11A:
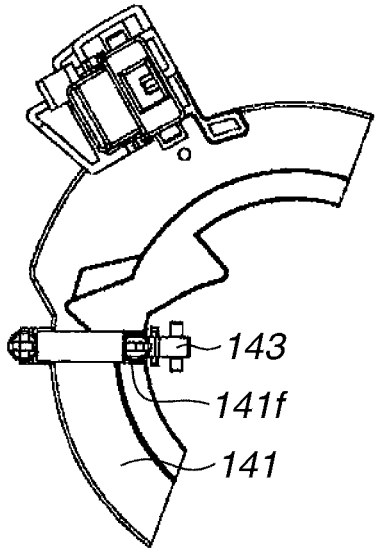
FIGS. 11A to 11C illustrate a position relationship and an operation between a cam member configuring a lock mechanism and a lock member.
Figure 11B:
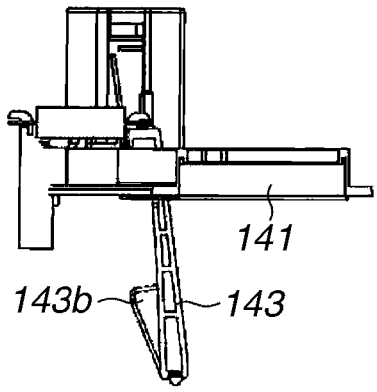
Figure 11C:
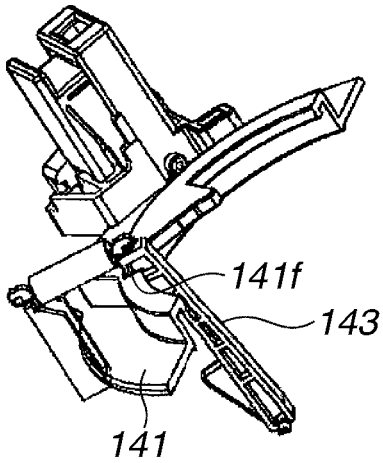
Figure 12A:
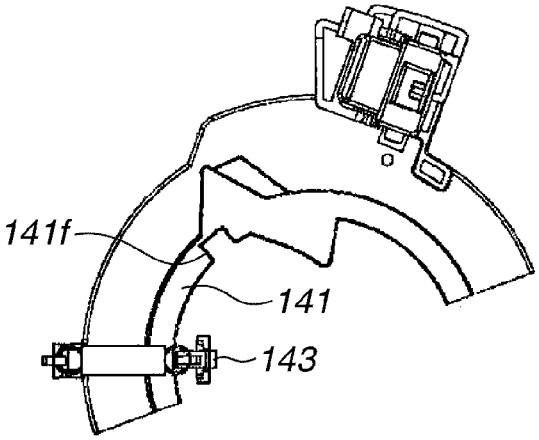
FIGS. 12A to 12C illustrate a position relationship and an operation between the cam member configuring the lock mechanism and the lock member.
Figure 12B:
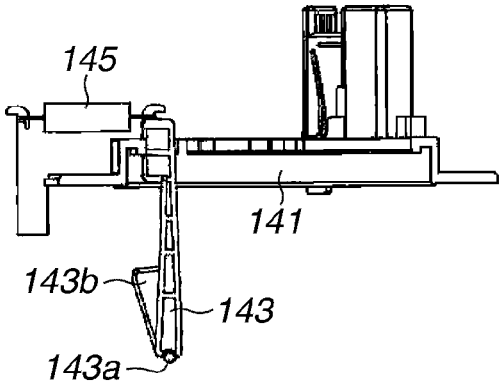
Figure 12C:
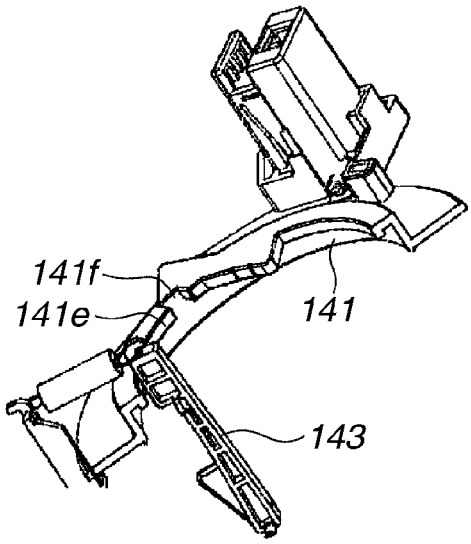

FIGS. 11A to 11C and FIG. 12A to 12C illustrate position relationships and operations of the cam member 141 and a locking member 143 which configure the locking mechanism. FIG. 11A and FIG. 12A are plane views as viewed from the cam member 141 side. FIG. 11B and FIG. 12B are side views. FIG. 11C and FIG. 12C are perspective views. FIG. 11 illustrates a state in which the cam member 141 is locked. FIG. 12 illustrates a state in which the lock is released. The locking mechanism includes the locking member 143 and a second spring member 145. A plurality of locking mechanisms, for example, three mechanisms in the present exemplary embodiment, are provided at intervals of 120 degrees to the center axis of the rotation shaft 118.

The locking member 143 is a plate-like member, and one end thereof is movably supported by a shaft 143*a* at the inner surface side of the leading edge wall 118*a* of the rotation shaft 118. The other end of the locking member 143 extends till at least the position of the cam member 141. One end of the second spring member 145 is connected to the locking member 143 and the other end is connected to the flange unit 115. The second spring member 145 is given the tensile force in advance and presses the locking member 143 onto an inner circumferential surface 141*e* of the cam member 141.

A concave portion 141*f* is provided on the inner circumferential surface 141*e* of the cam member 141. When the cam member 141 rotates and the concave portion 141*f* comes to the position of the locking member 143, a part of the upper end of the locking member 143 is inserted into the concave portion 141*f* by the elastic force of the second spring member 145. The locking member 143 serving as a restriction unit can be inserted into the concave portion 141*f* by the rotation of the cam member 141. Thus, the movement of the cam member 141 is restricted by inserting the locking member 143 into the concave portion 141*f*.

On the outer circumferential surface of the rotation shaft 118, through holes 122 such as slits (refer to FIG. 7B) are provided. When a part of the locking member 143 is inserted into the concave portion 141*f*, the convex portion 143*b*, which is a lower part of the locking member 143, penetrates the through hole 122 to project outside the outer circumferential surface.

Figure 13A:
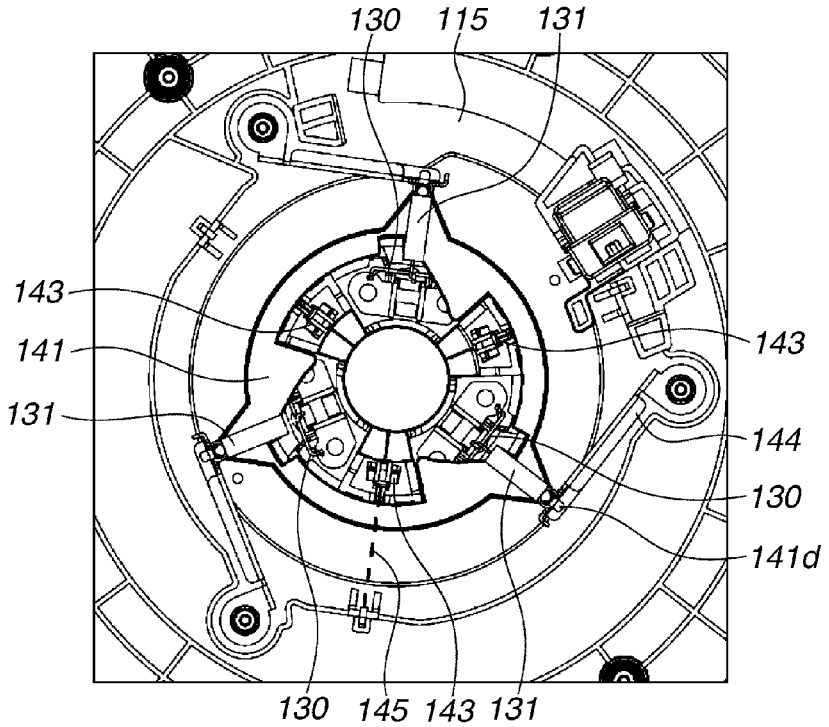
FIGS. 13A and 13B illustrate a state of the supporting apparatus when the fixing member is at an engaging position.
Figure 13B:
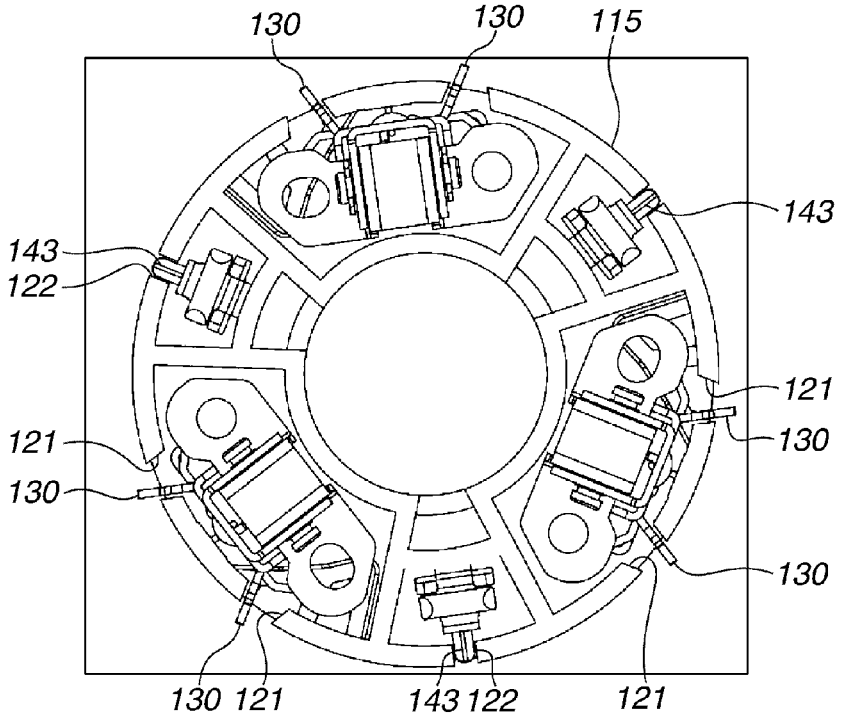

Then, an operation of the supporting apparatus 110 will be described. FIGS. 9A to 9C and FIGS. 13A and 13B illustrate states in which the fixing member 117 is at the engaging position. FIG. 13A illustrates a state in the operation unit side, which corresponds to FIG. 7A. FIG. 13B illustrates a state in the roll sheet end abutting side, which corresponds to FIG. 7B.

When the fixing member 117 is at the engaging position, the cam member 141 is at an angular position at which the convex portion 141*d* on the cam surface 141*a* abuts on the rotating member 144. The rotating member 144 is deflected to radially outward by the convex portion 141*d* on the cam surface 141*a*. By this deflection, the first spring member 131 is pulled radially outward. The first spring member 131 deflects the engaging member 130, which is connected to the first spring member 131, radially outward. Accordingly, the engaging member 130 projects from the groove 121 of the rotation shaft 118 and bites (engages) into the core tube 51. Thus, the supporting apparatus 110 is strongly fixed to the core tube 51.

Figure 14A:
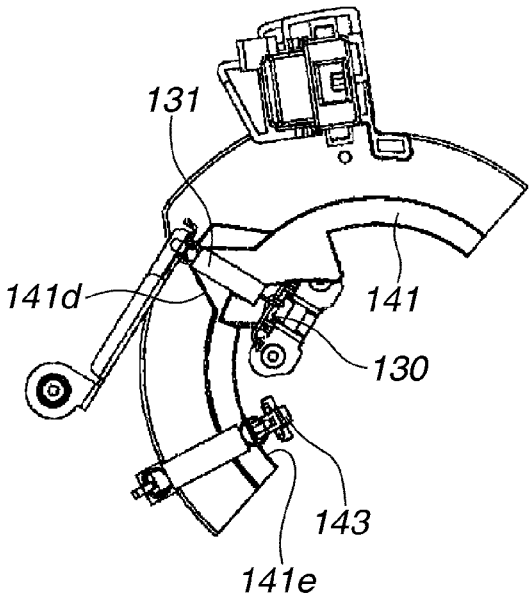
FIGS. 14A and 14B illustrate a state in which a core tube is fixed to a rotation shaft by the engaging member.
Figure 14B:
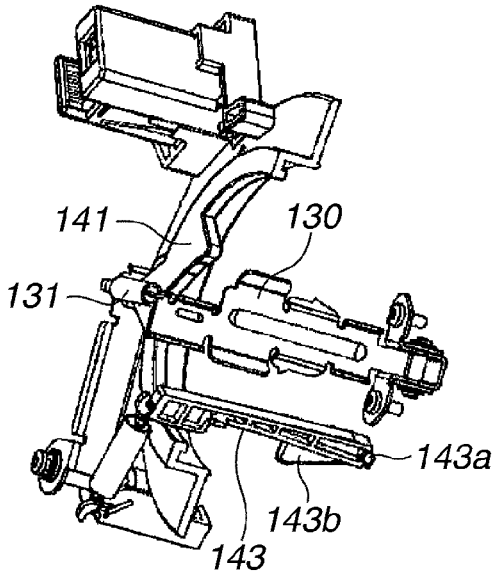

In the state as illustrated in FIGS. 12A to 12C and FIGS. 14A and 14B, the locking member 143 is at an angular position different from the concave portion 141*f* on the inner circumferential surface 141*e* of the cam member 141 and abuts on the inner circumferential surface 141*e* on which the concave portion 141*f* of the cam member 141 is not provided. Therefore, the locking member 143 is relatively at a radially inside position, so that the locking member 143 does not project from the through hole 122 and positions inside from the outer circumferential surface of the rotation shaft 118. FIGS. 14A and 14B illustrate a position relationship of the cam member 141, the locking member 143, and fixing member 117 in a state in which the core tube 51 is fixed to the rotation shaft 118 by the engaging member 130. FIG. 14A is a plane view as viewed from the cam member 141 side. FIG. 14B is a perspective view.

Figure 15A:
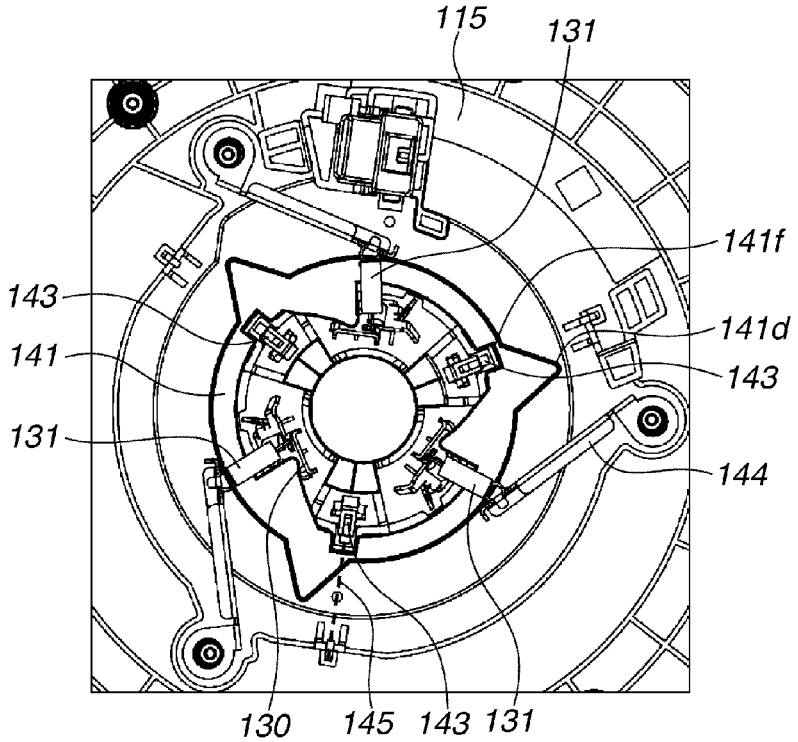
FIGS. 15A and 15B illustrate a state of the supporting apparatus when the fixing member is at an engagement releasing position.
Figure 15B:
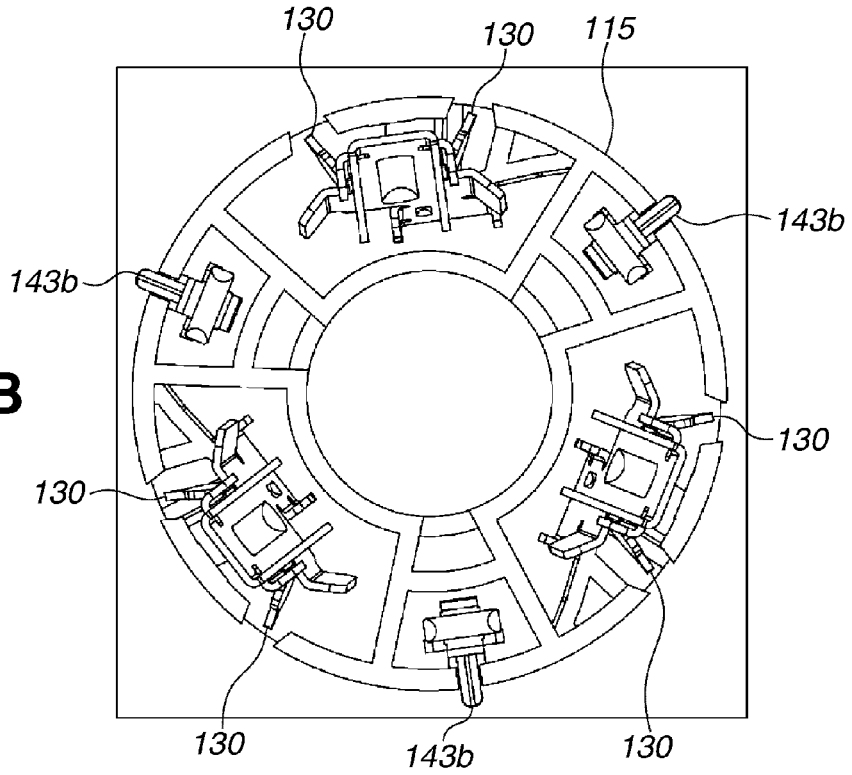

Next, an operation when the supporting apparatus 110 is pulled out from the core tube 51 will be described, referring to FIGS. 10A to 10C and FIGS. 15A and 15B. FIGS. 10A to 10C and FIGS. 15A and 15B illustrate a state in which the fixing member 117 is at the engagement releasing position. FIG. 15A illustrates a state in the operation unit side, which corresponds to FIG. 7A. FIG. 15B illustrates a state in the roll sheet end abutting side, which corresponds to FIG. 7B.

For pulling out the supporting apparatus 110 from the core tube 51, at first, an operator removes the supporting apparatus 110 in which the roll sheet is mounted, and rotates the cam member 141 by the grip portion 141*h* till the rotating member 144 comes to a position departing from the first convex portion 141*d* on the cam surface 141*a*. The rotating member 144 rotates radially inward by the elastic force of the first spring member 131. Further, the second convex portion 141*g* formed on the cam surface 141*e* inside the cam member 141 abuts on the fixing member 117, and the upper end of the fixing member 117 rotates radially inward.

Accordingly, the engaging member 130 is pulled into the inside of the rotation shaft 118 through the groove 121 on the outer circumferential surface of the rotation shaft 118, and then the engagement with the core tube 51 is released. In this state, the operator can remove the supporting apparatus 110 from the core tube 51. Further, as illustrated in FIG. 11, the concave portion 141*f* of the cam member 141 come to a position of the locking member 143 at that time, so that the lock member 143 is inserted into the concave portion 141*f* by the elastic force of the second spring member 145. Accordingly, the cam member 141 is locked so as not to rotate. At this time, the convex portion 143*b* at the lower part of the locking member 143 passes the through hole 122 and projects from the outer circumferential surface of the rotation shaft 118.

Then, an operation of mounting the supporting apparatus 110 to a roll will be described, referring to FIGS. 11A to 11C, FIGS. 13A and 13B, and FIGS. 15A and 15B. At first, as illustrated in FIGS. 11A to 11C and FIG. 15A, the locking member 143 is inserted into the concave portion 141*f* by the elastic force of the second spring member 145. Accordingly, rotation of the cam member 141 is locked, and an operation to project the engaging member 130 outside from the groove 121 of the rotation shaft 118 is restricted. At this time, the convex portion 143*b* at the lower part of the locking member 143 passes the through hole 122 and projects from the outer circumferential surface of the rotation shaft 118.

In this state, the rotation shaft 118 of the supporting apparatus 110 is fitted into the hollow portion of the core tube 51 of the roll sheet. The convex portion 143*b* of the locking member 143 projecting from the outer circumferential surface of the rotation shaft 118 abuts on the inner circumferential surface of the core tube 51 of the roll sheet, so that the convex portion 143*b* is returned from the through hole 122 to the inside of the rotation shaft 118, and moves to a more center side than the inner diameter of the core tube 51. With this operation, the locking member 143 is also pulled out from the concave portion 141*f* of the cam member 141, so that the lock of the cam member 141 is released. In this state, the operator can rotate the cam member 141 by operating the grip portion 141*h*.

When the cam member 141 is rotated clockwise, the convex portion 141*d* of the cam member 141 pushes out the rotating member 144 radially outward. By the movement of the rotating member 144, the fixing member 117 is pulled radially outward by the first spring member 131. Accordingly, the engaging member 130 projects outward from the groove 121 of the rotation shaft 118 and is engaged with the core tube 51, so that the supporting apparatus 110 can be fixed to the core tube 51.

Before attaching the core tube 51, rotation of the cam member 141 is locked, so that the engaging member 130 is held at an inside position of the rotation shaft 118, separating from the core tube 51. Therefore, it can be prevented that the cam member 141 rotates during installation and the engaging member 130 engages with the core tube 51 before positioning of the sheet is finished.

Locking of the cam member 141 is prepared at three places at intervals of 120 degrees. By pulling out all the cam members 143 prepared at these three places from the concave portions 141*f* of the cam member 141, the locking can be released for the first time. In other words, if only one or two locking members 143 are pulled out from the concave portions 141*f*, rotation locking of the cam member 141 cannot be released. For pulling out all the locking members 143 from the concave portions 141*f*, it is necessary to properly insert the supporting apparatus 110 in parallel with the axis of the core tube 51 so as to contact the rotation shaft 118 to all locking members 143. This operation is effective for securing properly installation of the supporting apparatus 110.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-027231 filed Feb. 10, 2011, which is hereby incorporated by reference herein in its entirety.

What is claimed is:

1. An apparatus capable of supporting a roll sheet which is wound in a roll shape on an outer circumferential surface of a core tube having a hollow portion, the apparatus comprising:

a pair of rotation shafts which are respectively fitted into end portions of the hollow portion of the core tube and configured to support the roll sheet rotatably and capable of being drawn out;

an engaging member moveable between a projecting position and a retracting position, wherein the engaging member projects from an outer circumferential surface of each rotation shaft abutting on the core tube to engage with the core tube at the projecting position and retracts inward from the outer circumferential surface of the each rotation shaft at the retracting position; and an engaging member moving unit configured to move the engaging member between the projecting position and the retracting position in accordance with an operation to the operation portion; and a locking unit configured to lock a movement of the engaging member by the engaging member moving unit;

wherein the locking unit locks the movement of the engaging member when the engaging member is at the retracting position.

2. The apparatus according to claim 1, wherein the engaging member moving unit comprises a cam member provided coaxially to the rotation shaft and relatively rotatable to the rotation shaft, wherein the engaging member is configured to move between the projecting position and the retracting position by rotation of the cam member.

3. The apparatus according to claim 2, wherein the cam member comprises an inner circumferential surface including a concave portion, wherein the locking unit comprises a locking member capable of inserting into the concave portion and a member for pressing the locking member onto the inner circumferential surface of the cam member, and wherein the locking member is inserted into the concave portion by rotation of the cam member and locks rotation of the cam member.

4. The apparatus according to claim 3, wherein the outer circumferential surface of the each rotation shaft includes a through hole, and wherein, if the locking member is inserted into the concave portion, the locking member passes the through hole and the projects from the outer circumferential surface of the rotation shaft, and if the rotation shaft is fitted into the hollow portion of the core tube, the locking member projecting from the outer circumferential surface of the rotation shaft abuts on the roll sheet to be pressed into the through hole, so that lock of rotation of the cam member is released.

5. The apparatus according to claim 1, wherein a plurality of the locking unit is provided.

6. The apparatus according to claim 1, further comprising a print unit configured to print an image on the roll sheet drawn out by the pair of rotation shafts.

7. The apparatus according to claim 6, wherein the printing unit prints the image in an ink-jet method in which a printing head unit applies ink to a sheet.

8. The apparatus according to claim 7, wherein an ink jet nozzle array in the print unit is formed in a range covering the maximum width of the sheet to be used for printing by the printing unit.

9. The apparatus according to claim 6, further comprising a cutting unit configured to cut the roll sheet on which the image is printed by the printing unit.

10. A apparatus capable of supporting a roll sheet which is wound in a roll shape on an outer circumferential surface of a core tube, the apparatus comprising:

a rotation shaft fitted into an end portion of the core tube;

an engaging member movable between a projecting position and a retracting position, wherein the engaging member projects from an outer circumferential surface of the rotation shaft fitted into the core tube to engage with the core tube at the projecting position, and retracts inwards from the outer circumferential surface of the rotation shaft at the retracting position;

an engaging member moving unit configured to move the engaging member between the projecting position and the retracting position; and a restriction unit configured to restrict an operation of the engaging member moving unit, wherein the restriction unit can restrict the operation of the engaging member moving unit when the engaging member is at the retracting position.

11. The apparatus according to claim 10, further comprising a restriction unit configured to restrict an operation of the engaging member moving unit only in a case where the engaging member is at the retracting position.

12. The apparatus according to claim 10, wherein the restriction unit includes a convex portion which projects from an outer circumferential surface of the rotation shaft when the restriction unit restricts an operation of the engaging member moving unit, and wherein, in a case where the convex portion is pressed to an inner circumferential surface of the core tube by fitting the rotation shaft into the core tube and moves inward the rotation shaft, restriction by the restriction unit is released.

13. The apparatus according to claim 12, wherein the engaging member moving unit includes a cam for moving the engaging member to the projecting position, and wherein the restriction unit engages with the cam in a state in which the engaging member is at the retracting position and restricts movement of the cam, and in a case where the convex portion is pressed to the inner circumferential surface of the core tube by fitting the rotation shaft into the core tube and moves inward the rotation shaft, engagement with the cam of the restriction unit is released.

* * * * *